US012662301B2

(12) United States Patent
Riley

(10) Patent No.: US 12,662,301 B2
(45) Date of Patent: Jun. 23, 2026

(54) PEPPER SPRAY DISPENSING SYSTEMS AND DEVICES AND METHODS OF USE

(71) Applicant: Sabre Security Equipment Corporation, Fenton, MO (US)

(72) Inventor: Louis F. Riley, Conway, AR (US)

( * ) Notice: Subject to any disclaimer, the term of this patent is extended or adjusted under 35 U.S.C. 154(b) by 132 days.

(21) Appl. No.: 18/125,370

(22) Filed: Mar. 23, 2023

(65) Prior Publication Data

US 2024/0124215 A1 Apr. 18, 2024

Related U.S. Application Data

(60) Provisional application No. 63/379,473, filed on Oct. 14, 2022.

(51) Int. Cl.

| | |
|---|---|
| ***B65D 83/14*** | (2025.01) |
| ***B05B 11/00*** | (2023.01) |
| ***B65D 83/20*** | (2006.01) |
| ***B65D 83/206*** | (2025.01) |
| ***B65D 83/46*** | (2006.01) |
| ***F41H 9/10*** | (2006.01) |

(52) U.S. Cl.
CPC ..... *B65D 83/206* (2013.01); *B65D 83/20* (2013.01); *B65D 83/46* (2013.01); *B65D 83/753* (2013.01); *F41H 9/10* (2013.01)

(58) Field of Classification Search
CPC ..... B05B 11/1053; B05B 11/1097; B65D 83/206; B65D 83/205; B65D 83/20; F41H 9/10
USPC ..... 222/402.11, 402.13
See application file for complete search history.

(56) References Cited

U.S. PATENT DOCUMENTS

| | | | |
|---|---|---|---|
| 3,443,333 | A | 5/1969 | Manatos |
| 4,044,922 | A | 8/1977 | Bordelon |
| 4,220,263 | A | 9/1980 | Caruso |
| 4,301,947 | A | 11/1981 | Potter |
| 4,434,914 | A | 3/1984 | Meshberg |
| 4,454,966 | A | 6/1984 | Hicks |
| 4,477,005 | A | 10/1984 | Martinez |

(Continued)

FOREIGN PATENT DOCUMENTS

| | | |
|---|---|---|
| DE | 102019001766 A1 | 9/2020 |
| GB | 2568870 | 6/2019 |

(Continued)

*Primary Examiner* — Charles P. Cheyney
(74) *Attorney, Agent, or Firm* — Hartman Global IP Law; Gary M. Hartman; Domenica N.S. Hartman

(57) ABSTRACT

Dispensing systems, dispensers, and methods for dispensing a pepper spray or other irritant from a container. Such dispensers include a cap, a nozzle within the cap so as to be translatable relative to the cap, an actuator within the cap so as to be translatable relative to the cap and relative to the nozzle, and a biasing member that urges the actuator and nozzle apart. The nozzle is configured to attach to a valve stem of a canister and has a passageway through which the pepper spray is dispersed. The dispenser has a partially actuated position following a first actuation stage resulting from the actuator being translated until the actuator abuts the nozzle without causing the nozzle to translate, and a fully actuated position following a second actuation stage resulting from the actuator being further translated to cause the nozzle to simultaneously translate with the actuator.

13 Claims, 6 Drawing Sheets

(56) References Cited

U.S. PATENT DOCUMENTS 4,667,851 A 5/1987 Wilkerson
5,088,121 A 2/1992 Wallace
5,287,995 A 2/1994 Redman et al.
5,310,086 A 5/1994 Julinot
5,348,193 A 9/1994 Bruckner et al.
5,392,975 A 2/1995 Blankenship, Jr.
5,420,766 A 5/1995 Hollis
D375,994 S 11/1996 Collins et al.
D376,766 S 12/1996 Cranford et al.
5,629,679 A 5/1997 Cranford et al.
5,683,168 A 11/1997 Teig et al.
5,785,208 A * 7/1998 Dobbs ..... B05B 11/1053 222/321.2
5,893,483 A 4/1999 Duran
5,949,338 A 9/1999 Masi et al.
5,971,240 A 10/1999 Dequaine
5,988,450 A 11/1999 Cassarino
6,145,654 A 11/2000 Loghman
D435,081 S 12/2000 Hsu
6,158,625 A * 12/2000 Siegel ..... B05B 11/1053 222/342
6,196,419 B1 3/2001 Haney et al.
6,199,726 B1 3/2001 Cardwell, III et al.
6,257,451 B1 * 7/2001 Siegel ..... B05B 15/50 239/106
6,264,067 B1 * 7/2001 Lasserre ..... B65D 83/20 239/491
D469,014 S 1/2003 Loghman-Adham et al.
6,592,011 B1 * 7/2003 Lammel ..... B65D 83/384 222/402.11
D501,311 S 2/2005 Passmore
6,957,750 B1 10/2005 Trudell
6,981,616 B2 1/2006 Loghman-Adham et al.
7,104,424 B2 * 9/2006 Kolanus ..... B65D 83/205 177/245
7,121,432 B2 * 10/2006 Kostal ..... F41H 9/10 222/113
7,121,434 B1 * 10/2006 Caruso ..... B65D 83/206 222/402.15
7,178,696 B2 2/2007 Larsen et al.
D555,838 S 11/2007 Robertson
D585,520 S 1/2009 Teig
D619,196 S 7/2010 Cardwell, III et al.
D636,050 S 4/2011 Kaufman
D642,376 S 8/2011 Pennington
8,006,868 B2 * 8/2011 Geiberger ..... B65D 83/20 222/571
D657,551 S 4/2012 Lynn
8,245,878 B2 8/2012 Smith et al.
8,310,360 B2 11/2012 Ross, Jr. et al.
8,313,009 B2 11/2012 Parisi et al.
D681,768 S 5/2013 Ross, Jr. et al.
8,499,974 B2 8/2013 Bennett
8,556,125 B2 10/2013 Dapper
D696,857 S 1/2014 Atteberry et al.
8,690,020 B1 4/2014 Murray
D712,502 S 9/2014 Olson
D713,922 S 9/2014 Sheikh et al.
8,935,940 B1 1/2015 Lough
D723,131 S 2/2015 Habermann et al.
8,985,397 B2 3/2015 Lord
D731,172 S 6/2015 Atteberry et al.
9,199,784 B2 12/2015 Caruso
9,216,853 B2 12/2015 Caruso
9,257,026 B2 2/2016 Kalina
9,267,767 B2 2/2016 Hwang
9,354,024 B1 5/2016 Perry
9,395,077 B2 7/2016 Flynn
9,423,208 B1 8/2016 Mahmalji
9,586,750 B1 3/2017 Mangold
9,605,930 B2 3/2017 Ben Yair et al.
9,691,244 B2 6/2017 Weng
9,715,805 B1 7/2017 Scully et al.
D800,446 S 10/2017 Sheikh et al.
9,815,612 B1 11/2017 Caruso
9,883,022 B2 1/2018 Barnes et al.
9,922,537 B2 3/2018 Shah et al.
9,927,213 B2 3/2018 Komperda
D818,076 S 5/2018 Sheikh
10,054,305 B1 8/2018 Slepack
D829,297 S 9/2018 Sheikh
10,139,101 B2 11/2018 Pires
10,144,563 B1 12/2018 Caruso
D838,337 S 1/2019 Frisk
10,175,032 B2 1/2019 Cooper
10,197,358 B2 2/2019 Hebden et al.
10,230,827 B2 3/2019 DiPerna et al.
10,247,524 B1 4/2019 Caruso
10,254,077 B2 4/2019 Crandall
10,309,753 B2 6/2019 Forsythe et al.
10,429,153 B2 10/2019 Gorham
10,479,592 B1 11/2019 Caruso
10,502,519 B2 12/2019 Stilson
10,520,282 B2 12/2019 Nangunoori
10,634,460 B1 4/2020 Sheikh
D887,520 S 6/2020 Nance et al.
D890,287 S 7/2020 Hymowitz
D892,628 S 8/2020 Caruso
10,731,845 B2 8/2020 Harvey
10,921,097 B1 2/2021 Rojas
10,996,028 B2 5/2021 Jimenez
11,022,406 B2 6/2021 Rice
11,071,364 B1 7/2021 Fowler
D941,951 S 1/2022 Crilley
11,287,225 B2 3/2022 Bogacz et al.
11,320,233 B2 5/2022 Clemons et al.
11,402,179 B2 8/2022 Nance et al.
11,413,478 B2 8/2022 Bina et al.
11,478,229 B1 * 10/2022 Casali ..... F21S 10/06
11,519,700 B2 12/2022 Clemons et al.
11,573,067 B1 2/2023 Faircloth, Jr.
11,883,836 B2 * 1/2024 Bartolucci ..... B65D 83/753
2004/0112924 A1 * 6/2004 Albisetti ..... B65D 83/20 222/402.13
2011/0288680 A1 11/2011 Samain et al.
2013/0105518 A1 5/2013 McPherson et al.
2013/0112771 A1 5/2013 Ki et al.
2014/0252036 A1 * 9/2014 Ballard ..... F41C 33/0263 222/113
2015/0069082 A1 3/2015 Breeden
2015/0312399 A1 10/2015 Teig
2015/0327092 A1 11/2015 Martch
2017/0087576 A1 3/2017 Fang et al.
2018/0087769 A1 3/2018 Pires

FOREIGN PATENT DOCUMENTS

WO 9731218 8/1997
WO 2011045468 4/2011
WO 2019119103 6/2019

* cited by examiner

PEPPER SPRAY DISPENSING SYSTEMS AND DEVICES AND METHODS OF USE

CROSS REFERENCE TO RELATED APPLICATIONS

This application claims the benefit of co-pending U.S. patent application Ser. No. 63/379,473 filed Oct. 14, 2022, the contents of which are incorporated herein by reference.

BACKGROUND OF THE INVENTION

The present invention generally relates to dispensing systems. The invention particularly relates to pepper spray devices for dispensing a pressurized product, such as a "pepper spray" or other irritant capable of use as a deterrent or incapacitant, and methods of dispensing such products.

Pressurized products are commonly dispensed from a canister with an actuator, for example a button, which is coupled to a valve stem connected to a valve within the container (canister). Particular but nonlimiting examples include aerosol dispensers adapted to dispense an aerosolized product (sometimes simply referred to as an aerosol) contained under pressure within an aerosol canister. Pressing the actuator moves the valve stem, often by a translation or pivot movement, which in turn opens the valve to allow the pressurized product to be dispensed through the valve, valve stem, and actuator. A potential problem with this arrangement arises if the product can be unintentionally discharged from the canister through the actions of a user or an errant object accidentally touching or pressing against the actuator. To avoid or at least reduce the risk of such incidents, it is well known to provide a protective cap that snaps onto the canister and surrounds the actuator to prevent access thereto and unintended actuations of the valve. However, protective caps can be at times lost or otherwise separated from their canisters.

In view of the above, it would be desirable if devices were available that were capable of reducing the risk of accidentally discharging a pressurized product, for example, an aerosol product, from a canister.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, pepper spray dispensing systems and devices for dispensing a pressurized pepper spray or other irritant from a container, and methods of dispensing such products.

According to one nonlimiting aspect, a pepper spray dispenser is provided that includes a cap configured to attach to a canister that contains a pressurized pepper spray, a nozzle disposed within the cap so as to be translatable relative to the cap, an actuator disposed in the cap so as to be translatable relative to the cap and relative to the nozzle, and a biasing member operatively interposed between the actuator and the nozzle and generating a biasing force that urges the actuator and the nozzle apart from each other and urges the actuator toward an unactuated position of the dispenser. The nozzle is configured to attach to a valve stem of the canister and comprises a passageway through which the pressurized pepper spray is able to pass from the container and be dispersed by the nozzle. The dispenser has a partially actuated position and a fully actuated position. The partially actuated position follows a first actuation stage resulting from the actuator being translated toward the valve stem of the canister until the actuator abuts the nozzle without causing the nozzle to translate and therefore without causing the valve stem to translate. The fully actuated position follows a second actuation stage resulting from the actuator being further translated toward the valve stem to cause the nozzle to simultaneously translate with the actuator and therefore also cause the valve stem to translate and release the pressurized pepper spray through the passageway within the nozzle.

According to another nonlimiting aspect, a pepper spray dispensing system is provided that includes a pepper spray dispenser as described above and further includes a canister. The cap is attached to the canister, and the nozzle is attached to a valve stem of the canister.

According to yet another nonlimiting aspect, a method is provided for dispensing a pepper spray from a canister with a pepper spray dispensing system as described above.

Technical aspects of pepper spray dispensing systems, dispensers, and methods as described above preferably include the ability to reduce the risk of accidental discharges of a pressurized pepper spray within a container, such as an aerosol canister, by implementing a two-stage action for operating an actuator of the container to open the valve of the container and/or by providing a guard at least partly surrounding the actuator.

These and other aspects, arrangements, features, and/or technical effects will become apparent upon detailed inspection of the figures and the following description.

DETAILED DESCRIPTION OF THE INVENTION

Figure 1:
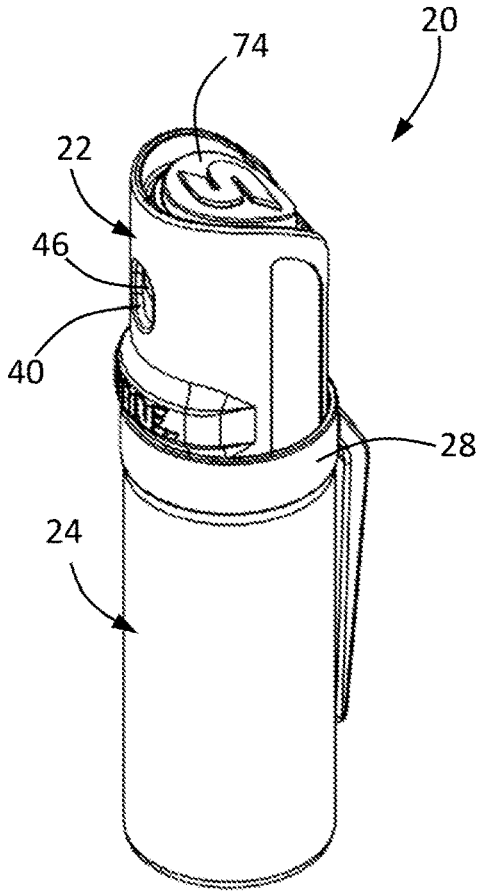
FIGS. 1 and 2 schematically represent, respectively, an assembly view and an exploded view of a nonlimiting embodiment of a pepper spray dispensing system according to certain aspects of the invention, wherein the system is represented as including a dispenser mounted on a canister.

The intended purpose of the following detailed description of the invention and the phraseology and terminology employed therein is to describe what is shown in the drawings, which include the depiction of and/or relate to one or more nonlimiting embodiments of the invention, and to describe certain but not all aspects of what is depicted in the drawings, including the embodiment(s) to which the drawings relate. The following detailed description also identifies certain but not all alternatives of the embodiment(s) depicted in the drawings. As nonlimiting examples, the invention encompasses additional or alternative embodiments in which one or more features or aspects shown and/or described as part of a particular depicted embodiment could be eliminated, and also encompasses additional or alternative embodiments that combine two or more features or aspects described as part of different embodiments. Therefore, the appended claims, and not the detailed description, are intended to recite what are believed to be aspects of the invention, including certain but not necessarily all of the aspects and alternatives described in the detailed description.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of a pepper spray dispensing system during its use and/or as represented in the drawings. All such relative terms are useful to describe the illustrated embodiment(s) but should not be otherwise interpreted as limiting the scope of the invention.

FIGS. 1-11 depict nonlimiting embodiments of dispensing systems 20 equipped with a dispenser 22 adapted to dispense a pressurized product from a container (referred to herein as a canister) 24. As a matter of convenience, the dispensing systems 20, dispensers 22, and canisters 24 will be described in reference to dispensing of pepper sprays aerosols, though it will be appreciated that the teachings of the invention are applicable to dispensing other types of irritant products capable of use as a deterrent or incapacitant. In addition, it should be appreciated that the teachings of the invention are also generally applicable to dispensing a wide range of other types of products (e.g., liquids, foams, pastes, etc.) that are capable of being contained under pressure in a container.

Figure 2:
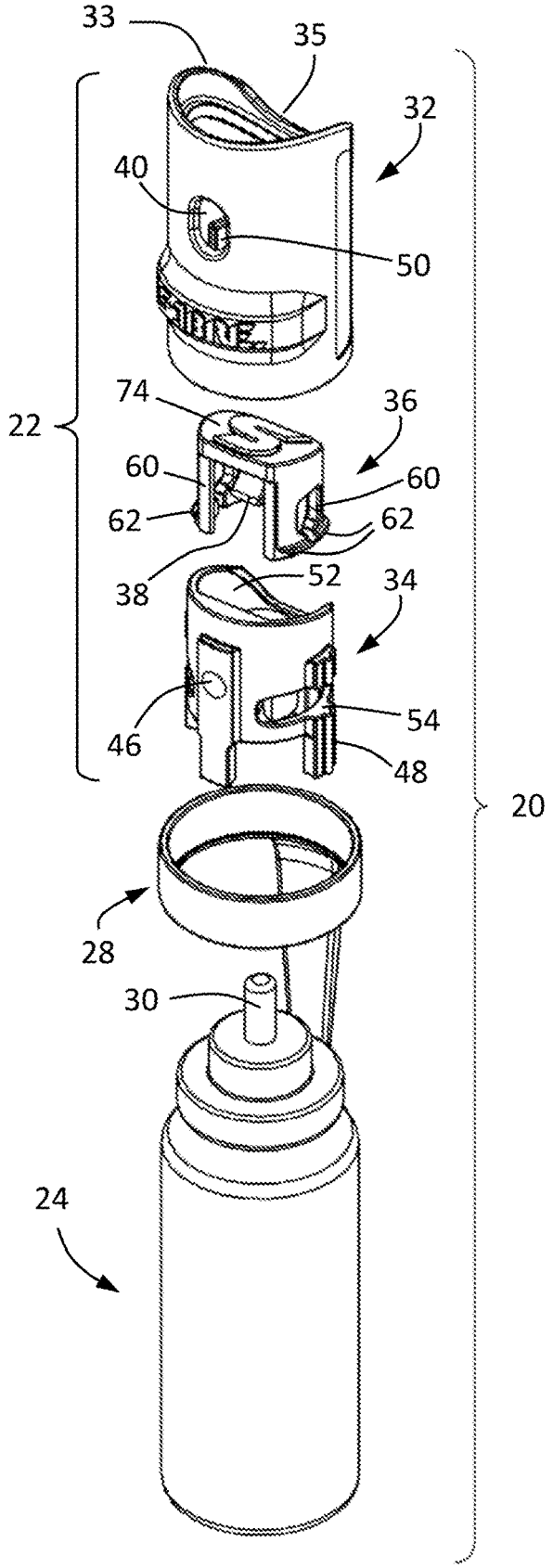
Figure 3:
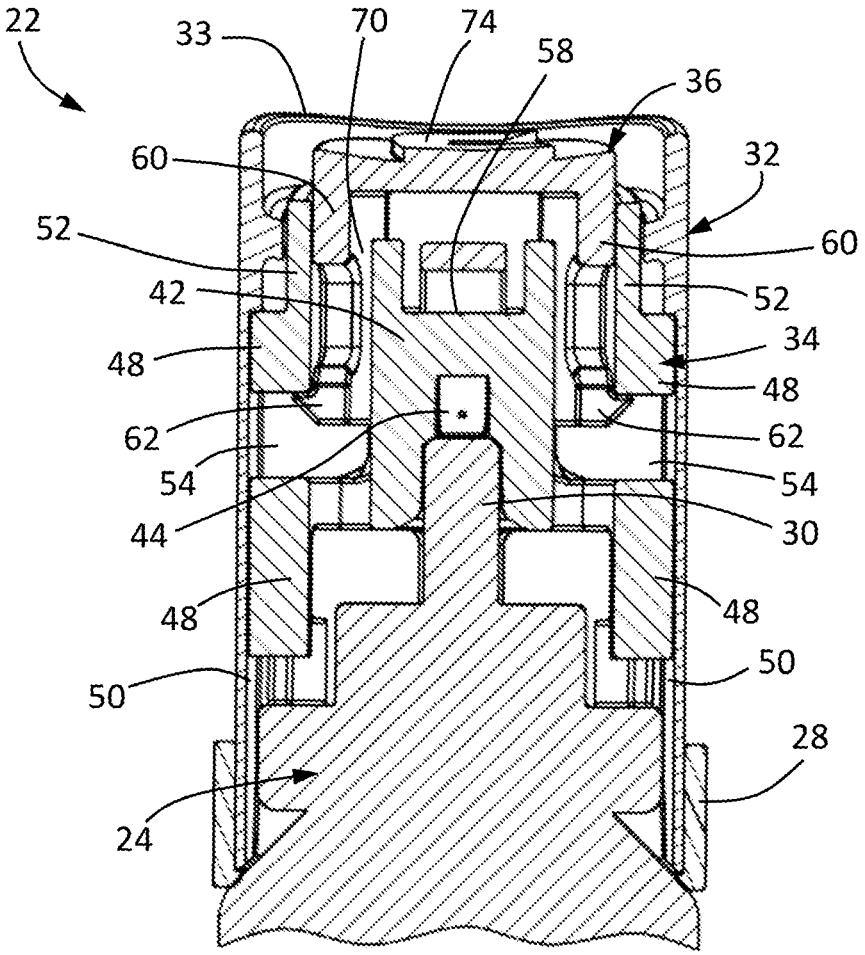
FIG. 3 is a longitudinal cross-sectional view of the dispenser and a portion of the canister of the dispensing system of FIG. 1.

With reference to FIGS. 1, 2, and 3, which represent components that are common to at least embodiments of FIGS. 4-6 and 8-10, the system 20 is depicted as including a dispenser 22 mounted on a canister 24. As noted above, the canister 24 may be an aerosol canister that contains an aerosol product (not shown) and, in the case of dispensing a pepper spray, typically also a propellant. The canister 24 may optionally be partially or fully enclosed within a housing that attaches to or is a component of the dispensing system 20 that includes the dispenser 22. The canister 24 contains a valve assembly that includes a valve stem 30 configured to be actuated toward the canister 24 to release the pepper spray under pressure through the valve assembly and its valve stem 30. The valve assembly in its entirety is not shown in the drawings, and can be of a known or subsequently developed type of valve assembly capable of releasing the contents of a container under pressure and therefore will not be described in any detail here. The dispenser 22 securely attaches to the canister 24 and is adapted to selectively actuate the valve assembly by pushing on the valve stem 30 in an axial direction of the stem 30.

In the nonlimiting embodiment shown, the dispenser 22 is represented as an assembly that includes a clip 28 that secures the dispenser 22 directly to the canister 24. As noted above, the dispenser 22 may instead be directly secured to a housing (not shown) that contains the canister 24 and forms an assembly with the dispenser 22. The dispenser 22 further includes a cap 32, a nozzle 34 that is partially enclosed by the cap 32 and engages the valve stem 30, and an actuator 36 (represented as a button) that engages and actuates the nozzle 34 to actuate the valve stem 30 and release the pepper spray from the canister 24. The cap 32 has a generally hollow cylindrical shape that defines a central axial bore with oppositely-disposed axial openings, a lower of which is sized to enable the nozzle 34 and actuator 36 to be inserted into the cap 32. The cap 32 has another opening, referred to herein as a window 40, that is disposed in a front face of the cap 32 through which the pepper spray passes when dispensed with the nozzle 34. The nozzle 34 attaches to the valve stem 30 and has an internal passageway through which the pepper spray flows and is dispensed from the nozzle 34. The passageway includes and fluidically connects an inlet orifice 44 (FIG. 3) and an outlet orifice 46 (FIGS. 1 and 2) of the nozzle 34, the former being physically and fluidically coupled to the valve stem 30 and the latter being aligned with the window 40 of the cap 32. As discussed in more detail below, the nozzle 34 and actuator 36 are both adapted to translate in an axial direction relative to the cap 32 to actuate the valve stem 30.

The dispenser 22 represented in FIGS. 1, 2, and 3 is configured to provide a safety capability for reducing the risk of accidental actuation of the valve assembly and a resultant and undesired dispensing of the pepper spray within the canister 24. In part, this safety capability is achieved as a result of the dispenser 22 being configured to provide a multi-stage actuation process for actuating the valve stem 30. The dispenser 22 has at least an unactuated position, a partially actuated position, and a fully actuated position. The partially actuated position follows a first actuation stage resulting from the actuator 36 being translated downwardly toward the valve stem 30 until the actuator 36 abuts the nozzle 34 without causing the nozzle 34 to translate and therefore without causing the valve stem 30 to translate. The fully actuated position follows a second actuation stage, resulting from the actuator 36 being further translated toward the valve stem 30 to cause the nozzle 34 to simultaneously translate with the actuator 36 and therefore also cause the valve stem 30 to translate and release the pepper spray through the passageway within the nozzle 34. The safety capability preferably also includes the position of the actuator 36 within the cap 32, in particular, as a result of a finger pad 74 that defines an uppermost surface of the actuator 36 being predominantly if not entirely recessed below the uppermost surface of the cap 32 when the actuator 36 is in its unactuated position. The uppermost surface of the cap 32 is defined by a rim 33 that at least partially surrounds the actuator 36. In the nonlimiting embodiment shown, the rim 33 slopes generally downwardly away from the front face of the cap 32 toward the rear of the cap 32 to define a U-shaped saddle-like contour 35 sized to ergonomically receive a user's finger when used to press down on the finger pad 74 of the actuator 36.

FIG. 3 represents the nozzle 34 as having an outer wall 52 that surrounds and suspends a central body 42 of the nozzle 34 within an internal cavity 70 of the nozzle 34 that is disposed between the outer wall 52 and central body 42. FIG. 3 further depicts the inlet orifice 44 of the nozzle 34 located within the central body 42, and the valve stem 30 fitted tightly into the inlet orifice 44 such that the nozzle 34 is supported by the valve stem 30. The nozzle 34 can travel axially up and down within the cap 32 such that the nozzle 34 can depress the valve stem 30 while the cap 32 remains fixedly mounted to the canister 24. Alignment tabs 48 project radially outwardly from the outer periphery of the nozzle 34 into complementary axially-aligned retention grooves 50 along the radially interior surface of the cap 32 to retain the nozzle 34 within the cap 32 and to ensure proper rotational alignment of the outlet orifice 46 of the nozzle 34 with the window 40 in the cap 32. The alignment tabs 48 slide axially along the retention grooves 50 to allow the nozzle 34 to travel axially within the cap 32 while maintaining alignment with the window 40. The grooves 50 also serve to capture the alignment tabs 48 and thereby retain the nozzle 34 within the cap 32, prevent the nozzle 34 from disengaging the valve stem 30, and prevent the nozzle 34 from passing through the upper axial opening of the cap 32 surrounded by the rim 33.

The internal cavity 70 of the nozzle 34 is sized and shaped to receive a portion of the actuator 36 therein. More particularly, and as represented in the nonlimiting embodiment of FIG. 3, the actuator 36 comprises tabs 60 that are received within portions of the internal cavity 70. The finger pad 74 of the actuator 36 is depicted as disposed above the nozzle 34 and having a generally circular shape that is represented as generally complementary to the shape of the internal cavity 70 of the nozzle 34, though other shapes are possible. A window 54 is represented as being formed in each of two opposing portions of the outer wall 52 of the nozzle 34 to retain and guide the travel of the actuator 36 relative to the nozzle 34. In FIG. 3, this arrangement is represented by the windows 54 receiving projections 62 disposed on the tabs 60 of the actuator 36 within the cavity 70 of the nozzle 34. Although in this embodiment the windows 54 extend completely through the outer wall 52 of the nozzle 34, the windows 54 may be in the form of recesses in the interior surface of the outer wall 52 without forming openings that extend all the way through the outer wall 52. The engagement of the projections 62 of the actuator 36 with the windows 54 of the nozzle 34 enable the actuator 36 to translate axially within the nozzle 34 and maintain a preferred rotational orientation of the actuator 36 relative to the nozzle 34. As a result, the actuator 36 can translate upwardly within the nozzle 34 to its unactuated position in which the projections 62 engage the upper extents of their respective windows 54 (FIG. 3), and the actuator 36 can translate downwardly within the nozzle 34 through its partially actuated position to the fully actuated position. The lower extents of the projections 62 are angled radially outward and upward to facilitate insertion of the projections 62 into the windows 54 by pressing the actuator 36 into the nozzle 34 until the projections 62 encounter the windows 54 and are able to flex radially outward to engage the windows 54.

Figure 4:
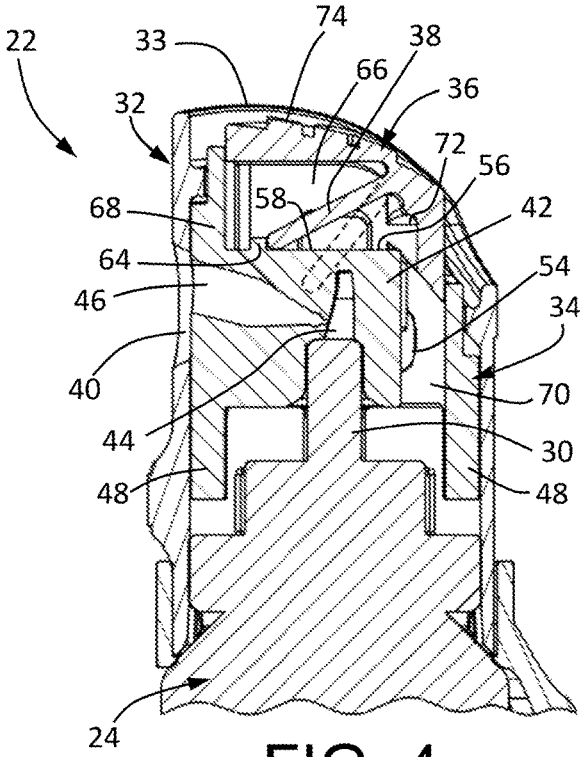
FIGS. 4, 5, and 6 are longitudinal cross-sectional views of a first embodiment of the dispenser and canister of FIG. 1 taken in a plane transverse to the longitudinal cross-sectional view of FIG. 3 and representing the dispenser in differ stages of actuation.
Figure 5:
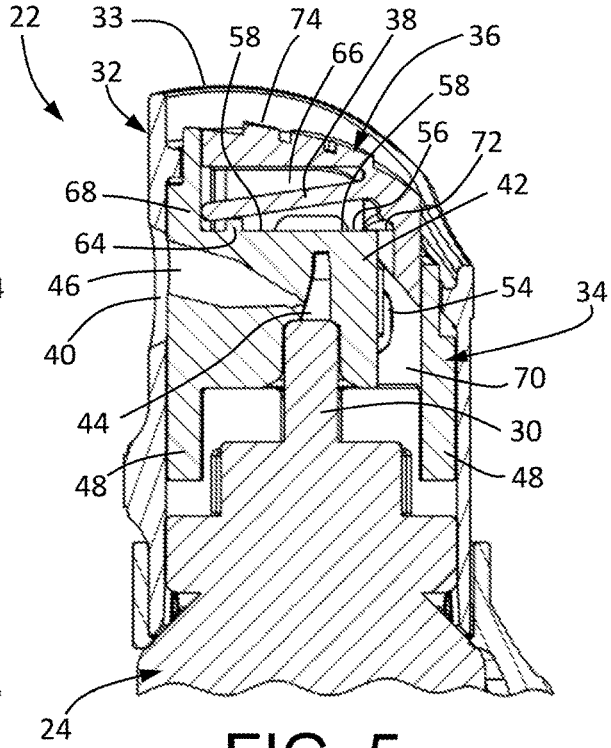
Figure 6:
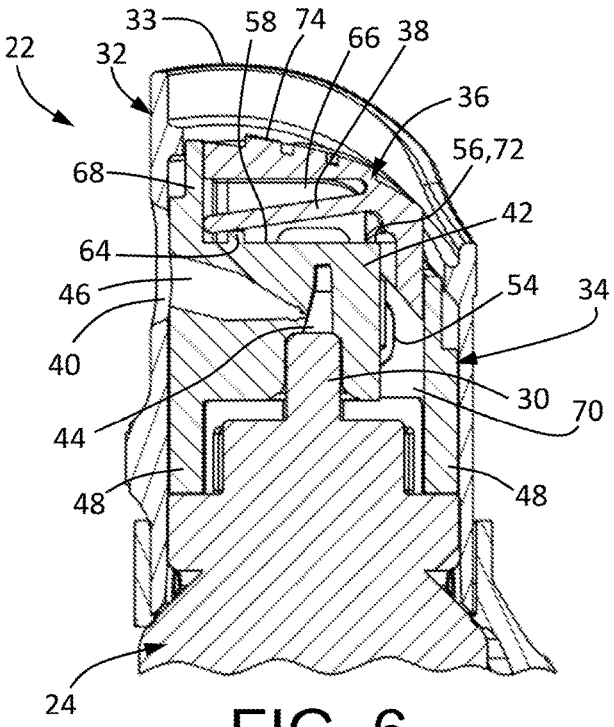

With reference now to the embodiment represented in FIGS. 4, 5, and 6, FIG. 4 represents the unactuated position in which the finger pad 74 of the actuator 36 is shown predominantly if not entirely below the rim 33 of the cap 32. FIG. 5 represents the partially actuated position following the first actuation stage, in which the actuator 36 has translated downwardly toward the valve stem 30 until an internal shoulder 72 of the actuator 36 has abutted an abutment surface 56 of the nozzle 34 without causing the nozzle 34 to translate and therefore without causing the valve stem 30 to translate. FIG. 6 represents the fully actuated position following the second actuation stage, in which the actuator 36 has been further translated toward the valve stem 30 to cause the nozzle 34 to translate therewith, thereby also causing the valve stem 30 to translate and release the pepper spray.

Resistance of the actuator 36 to actuation during the first actuation stage is provided by a biasing member, represented in the drawings as a flexible lever 38. The flexible lever 38 is cantilevered from the actuator 36 to engage a bearing surface 58 on the central body 42 of the nozzle 34. In the nonlimiting embodiment of FIGS. 4, 5, and 6, the bearing surface 58 is coplanar with the abutment surface 56 against which the shoulder 72 of the actuator 36 abuts, though such an arrangement is not required. In FIG. 4, the flexible lever 38 is portrayed in phantom in a free state as well as shown engaged with the bearing surface 58, evidencing the flexing of the lever 38 when the actuator 36 is assembled with the nozzle 34 such that the lever 38 biases the nozzle 34 and actuator 36 apart from each other toward the unactuated position. Though a single flexible lever 38 is represented, the dispenser 22 could utilize multiple levers and/or biasing elements other than a cantilevered flexible lever 38. As evident from FIGS. 5 and 6, during the first actuation stage the flexible lever 38 resiliently pivots upward as the actuator 36 is urged, for example, by a user's finger, to translate axially toward the nozzle 34 until the shoulder 72 of the actuator 36 abuts the abutment surface 56 of the nozzle 34 in the partially actuated position represented in FIG. 5. The biasing force generated by the lever 38 increases during the first actuation stage. Pivoting of the flexible lever 38 during the first actuation stage is a result of the actuator 36 translating toward the bearing surface 58 of the nozzle 34, such that the bearing surface 58 forces the lever 38 into a cavity 66 within the actuator 36. During the first actuation stage, a distal end of the flexible lever 38 also slides along the bearing surface 58 toward a bearing wall 68 of the nozzle 34, against which the lever 38 may optionally abut when the shoulder 72 of the actuator 36 abuts the abutment surface 56 of the nozzle 34 as also represented in FIG. 5. Preferably, the flexible lever 38 is sufficiently stiff to maintain the actuator 36 in the unactuated position when not being pressed downwardly by a user, but is not so stiff as to be capable alone of forcing the nozzle 34 to actuate the valve stem 30.

FIGS. 4-6 evidence that, with the dispenser 22 in its unactuated position (FIG. 4), a user is able to press downwardly on the finger pad 74 of the actuator 36 during the first actuation stage to cause the actuator 36 to travel axially within the nozzle 34 and toward the abutment and bearing surfaces 56 and 58 of the nozzle 34. At the completion of the first actuation stage, the dispenser 22 has acquired its partially actuated position in which the shoulder 72 of the actuator 36 is abutted against the abutment surface 56 of the nozzle 34 as represented in FIG. 5. As such, the biasing force generated by the lever 38 cannot be increased by further pressing on the actuator 36. In its fully flexed/pivoted position represented in FIG. 5, the biasing force generated by the flexed lever 38 is insufficient to cause the nozzle 34 to travel axially to actuate the valve stem 30 and open the valve assembly.

As represented in FIG. 6, further pressure on the actuator 36 by the user causes the actuator 36 to further travel downwardly toward the canister 24, causing the nozzle 34 to move in unison with the actuator 36 as a result of the shoulder 72 of the actuator 36 bearing against the abutment surface 56 of the nozzle 34, until the nozzle 34 sufficiently presses on the valve stem 30 to cause the valve assembly to open. With the valve assembly open, pepper spray can be dispensed through the valve stem 30 and through the passageway of the nozzle 34 between its inlet and outlet orifices 44 and 46, thereafter exiting the dispenser 22 through the window 40 of the cap 32. To reclose the valve assembly, the user simply releases pressure from the actuator 36, which allows the valve stem 30 to force the nozzle 34 upward, thereby closing the valve and returning the dispenser 22 to its unactuated position of FIG. 4.

The bearing surface 58 of the nozzle 34 represented in FIGS. 4, 5, and 6 includes a detent 64 in the form of a raised rib or other surface protruding from the bearing surface 58. During the first actuation stage, the distal end of the flexible lever 38 must surmount the detent 64 as the distal end slides along the bearing surface 58 toward the bearing wall 68 of the nozzle 34, abruptly causing the lever 38 to pivot upward, after which the lever 38 is able to pivot toward the bearing surface 58 to some degree as the distal end of the lever 38 slides past the detent 64.

Figure 7:
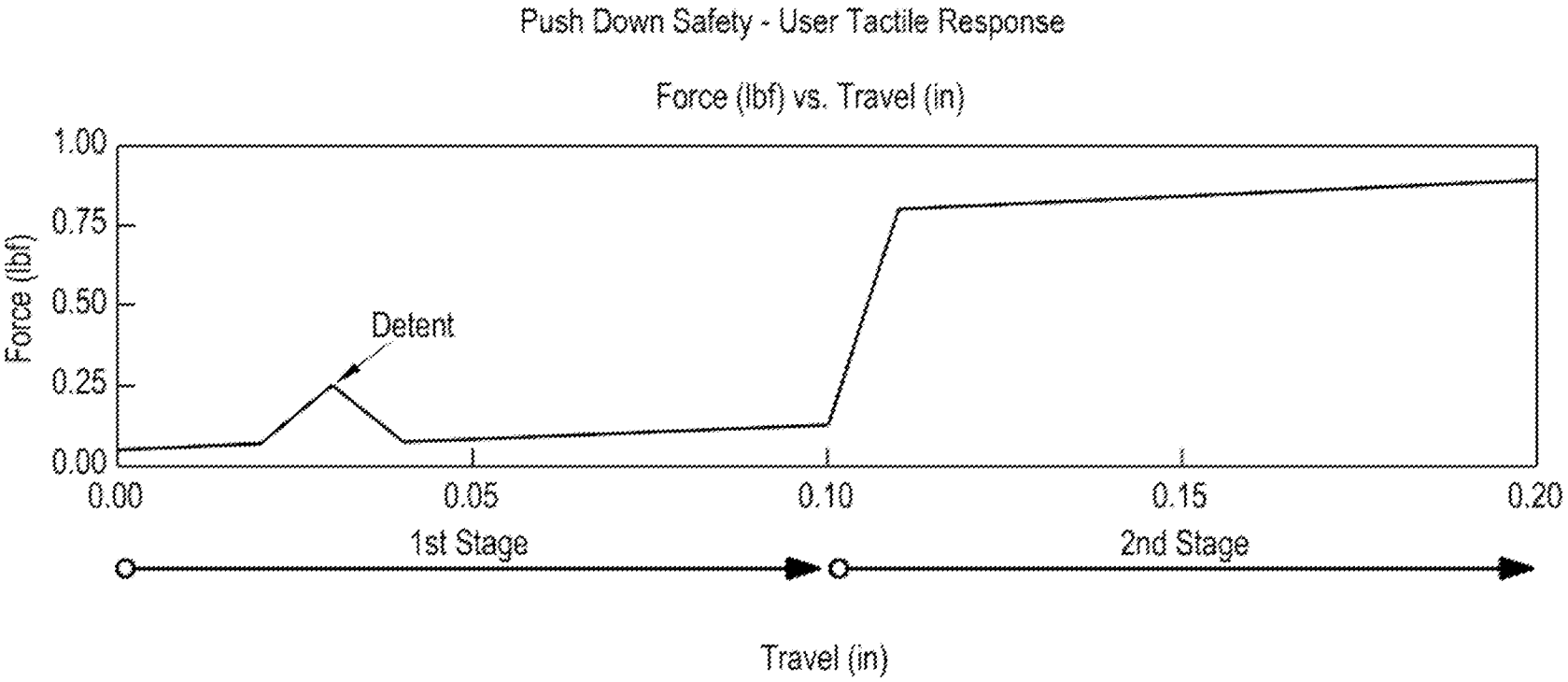
FIG. 7 is a graph plotting forces associated with the actuation of the dispenser of FIGS. 4 through 6.

The effect of the detent 64 is evident from FIG. 7, in which exemplary forces that may be utilized to actuate the dispenser 22 through its first and second actuation stages are plotted. As evident from FIG. 7, the force necessary to actuate the actuator 36 during the first actuation stage before its shoulder 72 abuts against the abutment surface 56 of the nozzle 34 (i.e., the biasing force generated by the lever 38) increases but is relatively low due to the limited stiffness of the flexible lever 38, whereas the force necessary to actuate the actuator 36 and nozzle 34 together during the second actuation stage is markedly greater due to the biasing force of the flexible lever 38 (which is now at a constant maximum) combining with the resistance of the valve stem 30. This transition of the forces required to translate the actuator 36 between the first and second actuation stages can be seen as abrupt in FIG. 7, increasing at a much greater rate than the more gradual increase in force that occurs during either of the first or second actuation stage. The intent of this abrupt increase serves to resist unintended actuation of the nozzle 34 as well as provide sensory feedback to the user immediately prior to an intentional actuation of the valve stem 30.

During the first actuation stage, though there is overall a gradual increase in the actuation force generated by the flexible lever 38, this gradual increase is interrupted when the flexible lever 38 encounters and must surmount the detent 64, resulting in an abrupt but transitory peak associated with the detent in FIG. 7. The intent of this transitory peak is to provide sensory feedback to the user, as well as provide additional resistance to an accidental actuation of the actuator 36 that might otherwise unintentionally actuate the valve stem 30.

Figure 8:
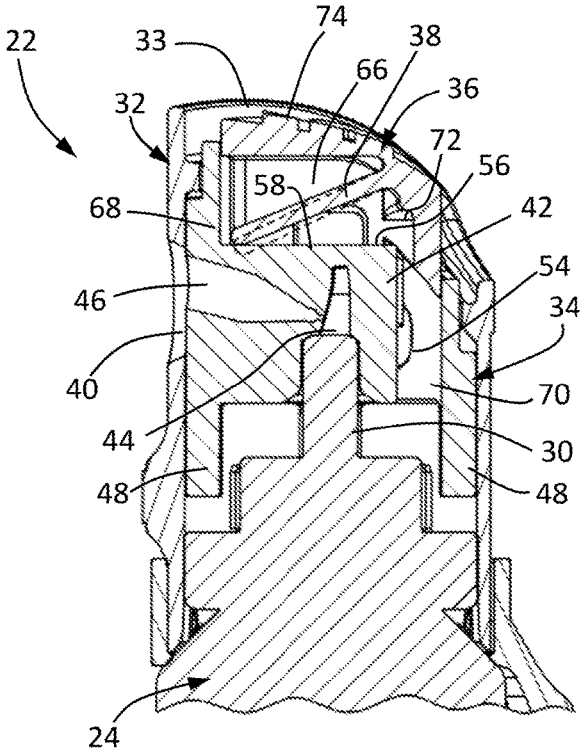
FIGS. 8, 9, and 10 are longitudinal cross-sectional views of a second embodiment of the dispenser and canister of FIG. 1 taken in a plane transverse to the longitudinal cross-sectional view of FIG. 3 and representing the dispenser in differ stages of actuation.
Figure 9:
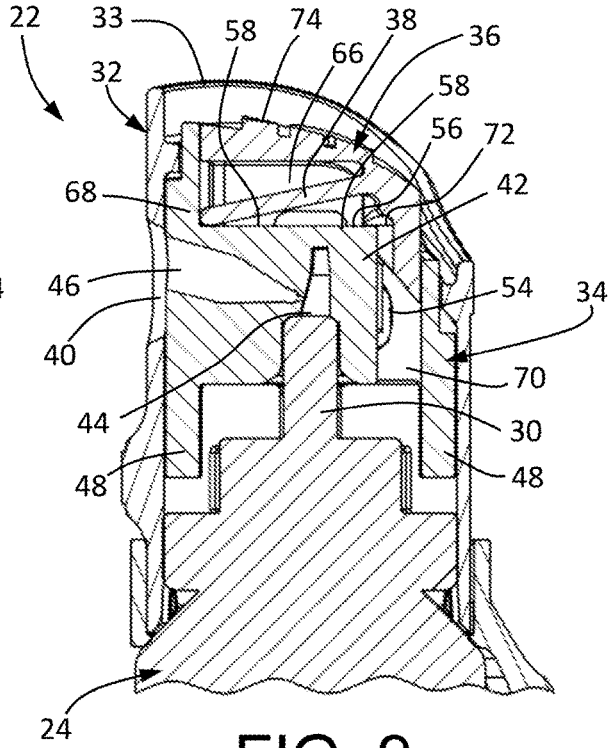
Figure 10:
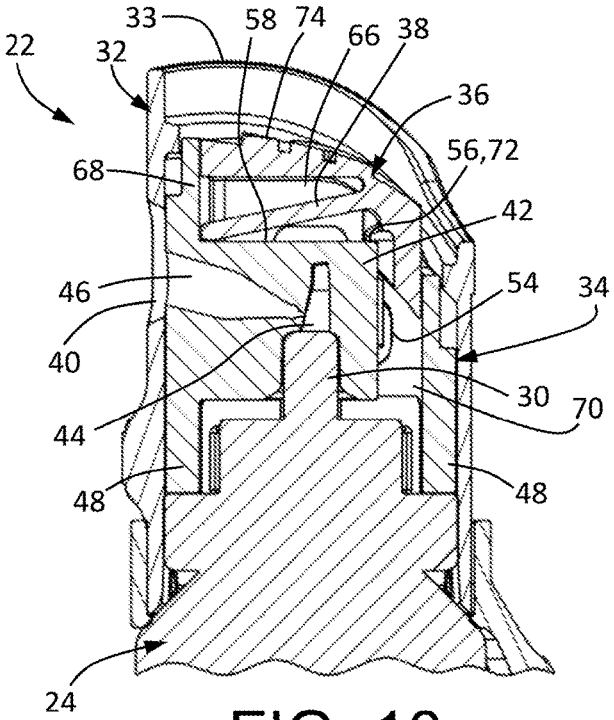
Figure 11:
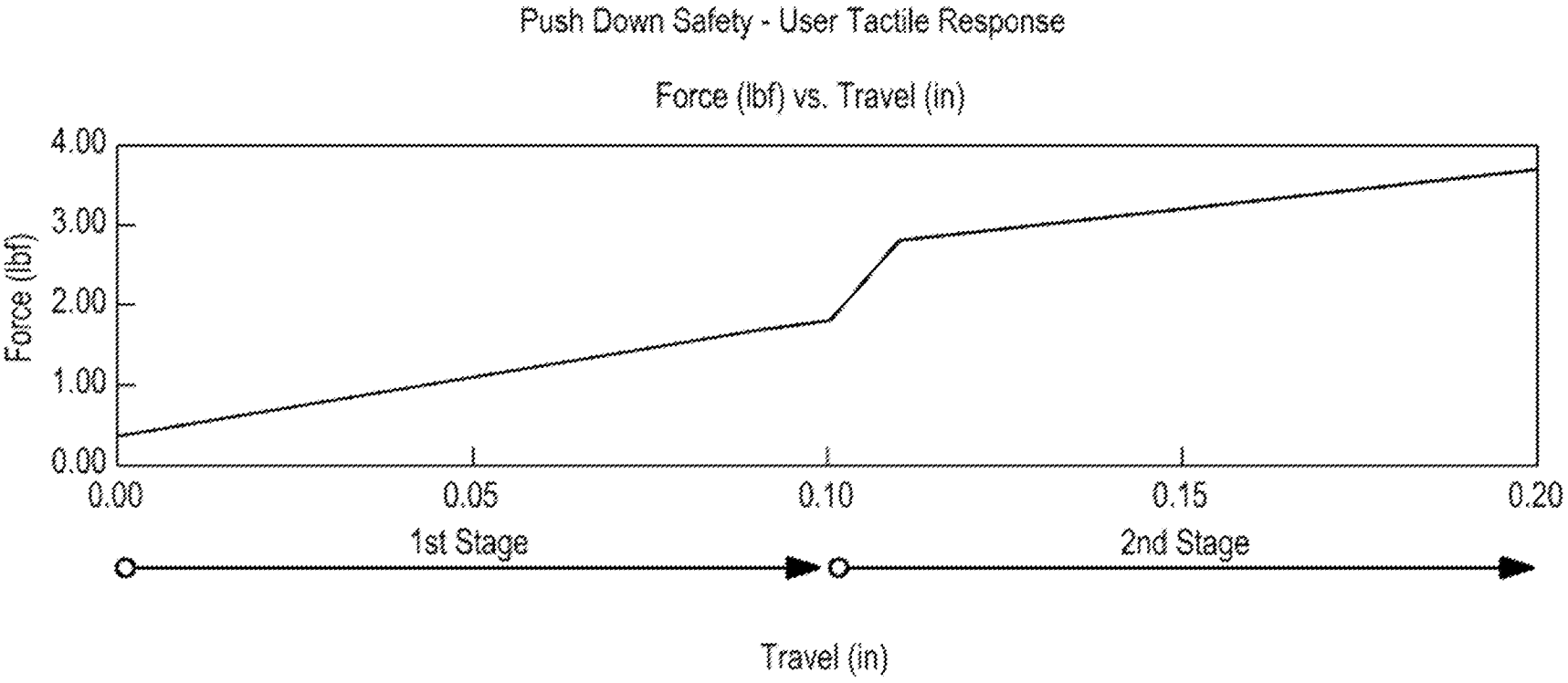
FIG. 11 is a graph plotting forces associated with the actuation of the dispenser of FIGS. 8 through 10.

FIGS. 8, 9, and 10 correspond to FIGS. 4, 5, and 6, but in relation to a second embodiment of the dispenser 22 that differs from FIGS. 4, 5, and 6 by the absence of the detent 64 and a longer and more rigid flexible lever 38, resulting in a greater maximum force during the first actuation stage but without an intermediate peak in force as evident from FIG. 11. As such, the biasing force generated by the lever 38 gradually increases throughout the first actuation stage, reaching a maximum that cannot increase during the second actuation stage due to the engagement of the shoulder 72 of the actuator 36 with the abutment surface 56 of the nozzle 34 preventing relative movement between the actuator 36 and nozzle 34. Other aspects of the embodiment of FIGS. 8, 9, and 10 can be, in terms of structure, function, materials, etc., essentially as was described for the embodiment of FIGS. 4, 5, and 6.

In view of the above, the dispensers 22 represented in the drawings each provide a two-stage valve actuation motion, in which during the first stage the actuator 36 is depressed a first predefined distance before the nozzle 34 is engaged, and the valve assembly does not open because it has not yet been actuated with the nozzle 34, and then during the second stage the actuator 36 is further depressed to actuate the nozzle 34 and valve stem 30 to open the valve assembly. This two-stage action of the safety mechanism of the dispenser 22 can prevent accidental discharge of the pepper spray that might otherwise be caused by the user resting a finger too heavily on the nozzle or by small accidental bumps of the nozzle 34.

Additionally, an safety feature of the dispenser 22 is provided as a result of both the actuator 36 and he nozzle 34 being guarded, that is, protected, against accidental actuation by the rim 33 of the cap 32 that at least partly surrounds both the actuator 36 and the nozzle 34. This arrangement further prevents the nozzle 34 from being directly engaged and actuated because the rim 33 of the cap 32 and the actuator 36 prevent a user's finger from directly pressing against the nozzle 34. Thus, the rim 33 forms a guard that prevents accidental discharge of spray resulting from an unintended engagement by a finger or errant object.

While the components of the dispensers 22 disclosed herein may be formed in any suitable manner, in some embodiments, some or all of the various components may be injection molded, for example, from one or more polymeric materials.

As previously noted above, though the foregoing detailed description describes certain aspects of one or more particular embodiments of the invention, alternatives could be adopted by one skilled in the art. For example, the dispensing systems, canisters, dispensers, and their components could differ in appearance and construction from the embodiments described herein and shown in the drawings, functions of certain components of the systems and dispensers could be performed by components of different construction but capable of a similar (though not necessarily equivalent) function, and various materials could be used in the fabrication of the canisters, dispensers, and/or their components. As such, and again as was previously noted, it should be understood that the invention is not necessarily limited to any particular embodiment described herein or illustrated in the drawings.

The invention claimed is:

1. A pepper spray dispenser comprising:

a cap configured to attach to a canister that contains a pressurized pepper spray;

a nozzle disposed within the cap so as to be translatable relative to the cap, the nozzle being configured to attach to a valve stem of the canister, the nozzle comprising a passageway through which the pressurized pepper spray is able to pass from the container and be dispersed by the nozzle;

an actuator disposed in the cap so as to be translatable relative to the cap and relative to the nozzle;

a biasing member operatively interposed between the actuator and the nozzle and generating a biasing force that urges the actuator and the nozzle apart from each other and urges the actuator toward an unactuated position of the pepper spray dispenser;

wherein the pepper spray dispenser has a partially actuated position and a fully actuated position, the partially actuated position follows a first actuation stage resulting from the actuator being translated toward the valve stem of the canister until the actuator abuts the nozzle without causing the nozzle to translate and therefore without causing the valve stem to translate, and the fully actuated position follows a second actuation stage resulting from the actuator being further translated toward the valve stem to cause the nozzle to simultaneously translate with the actuator and therefore also cause the valve stem to translate and release the pressurized pepper spray through the passageway within the nozzle;

wherein the biasing force generated by the biasing member increases during the first actuation stage and does not increase during the second actuation stage;

wherein during the first actuation stage a distal end of the biasing member slides along a bearing surface of the nozzle; and wherein the bearing surface comprises a detent that the biasing member surmounts during the first actuation stage, the detent causing an abrupt but transitory increase in the biasing force during the first actuation stage.

2. A pepper spray dispenser comprising:

a cap configured to attach to a canister that contains a pressurized pepper spray;

a nozzle disposed within the cap so as to be translatable relative to the cap, the nozzle being configured to attach to a valve stem of the canister, the nozzle comprising a passageway through which the pressurized pepper spray is able to pass from the container and be dispersed by the nozzle;

an actuator disposed in the cap so as to be translatable relative to the cap and relative to the nozzle;

a biasing member operatively interposed between the actuator and the nozzle and generating a biasing force that urges the actuator and the nozzle apart from each other and urges the actuator toward an unactuated position of the pepper spray dispenser;

wherein the pepper spray dispenser has a partially actuated position and a fully actuated position, the partially actuated position follows a first actuation stage resulting from the actuator being translated toward the valve stem of the canister until the actuator abuts the nozzle without causing the nozzle to translate and therefore without causing the valve stem to translate, and the fully actuated position follows a second actuation stage resulting from the actuator being further translated toward the valve stem to cause the nozzle to simultaneously translate with the actuator and therefore also cause the valve stem to translate and release the pressurized pepper spray through the passageway within the nozzle;

wherein the biasing force generated by the biasing member increases during the first actuation stage and does not increase during the second actuation stage;

wherein during the first actuation stage a distal end of the biasing member slides along a bearing surface of the nozzle;

wherein the bearing surface comprises a detent that the biasing member surmounts during the first actuation stage, the detent causing an abrupt but transitory increase in the biasing force during the first actuation stage; and wherein the biasing member bears against the bearing surface of the nozzle that causes the biasing member to be flexed and pivoted in the unactuated position of the pepper spray dispenser.

3. A pepper spray dispenser comprising:

a cap configured to attach to a canister that contains a pressurized pepper spray;

a nozzle disposed within the cap so as to be translatable relative to the cap, the nozzle being configured to attach to a valve stem of the canister, the nozzle comprising a passageway through which the pressurized pepper spray is able to pass from the container and be dispersed by the nozzle;

an actuator disposed in the cap so as to be translatable relative to the cap and relative to the nozzle;

a biasing member operatively interposed between the actuator and the nozzle and generating a biasing force that urges the actuator and the nozzle apart from each other and urges the actuator toward an unactuated position of the pepper spray dispenser;

wherein the pepper spray dispenser has a partially actuated position and a fully actuated position, the partially actuated position follows a first actuation stage resulting from the actuator being translated toward the valve stem of the canister until the actuator abuts the nozzle without causing the nozzle to translate and therefore without causing the valve stem to translate, and the fully actuated position follows a second actuation stage resulting from the actuator being further translated toward the valve stem to cause the nozzle to simultaneously translate with the actuator and therefore also cause the valve stem to translate and release the pressurized pepper spray through the passageway within the nozzle;

wherein the biasing force generated by the biasing member increases during the first actuation stage and does not increase during the second actuation stage;

wherein during the first actuation stage a distal end of the biasing member slides along a bearing surface of the nozzle;

wherein the bearing surface comprises a detent that the biasing member surmounts during the first actuation stage, the detent causing an abrupt but transitory increase in the biasing force during the first actuation stage; and wherein translating of the actuator during the first actuation stage causes the biasing member to flex and pivot.

4. The pepper spray dispenser of claim 1, wherein in the unactuated position the biasing member is sufficiently stiff to maintain the actuator in the unactuated position but is not sufficiently stiff to be capable alone of forcing the nozzle to actuate the valve stem.

5. The pepper spray dispenser of claim 1, wherein the actuator and the nozzle comprise complementary surfaces that engage each other following the first actuator stage to prevent the actuator from translating relative to the nozzle.

6. The pepper spray dispenser of claim 1, wherein the actuator comprises a tab having a projection that engages a window in the nozzle to retain the actuator on the nozzle.

7. The pepper spray dispenser of claim 1, wherein the nozzle has an internal passageway through which the pressurized pepper spray flows and is dispensed from the nozzle, the passageway comprising and fluidically connecting an inlet orifice and an outlet orifice of the nozzle, the inlet orifice being adapted to physically and fluidically couple to the valve stem, the outlet orifice being aligned with a window of the cap.

8. The pepper spray dispenser of claim 7, wherein the nozzle comprises a tab that projects outwardly from the nozzle into a complementary retention groove of the cap to retain the nozzle within the cap and maintain rotational alignment of the outlet orifice of the nozzle with the window of the cap.

9. The pepper spray dispenser of claim 1, wherein the biasing member comprises a flexible lever.

10. The pepper spray dispenser of claim 1, wherein the biasing member consists of a flexible lever.

11. A pepper spray dispensing system comprising the pepper spray dispenser of claim 1, the pepper spray dispensing system further comprising the canister, the cap being attached to the canister, and the nozzle being attached to the valve stem of the canister.

12. A method of dispensing a pressurized pepper spray from the canister with the pepper spray dispensing system of claim 11, the method comprising:

pressing the actuator a first distance toward the nozzle during the first actuation stage to resiliently engage the biasing member without translating the nozzle; and further pressing the actuator an additional distance toward the nozzle during the second actuation stage to translate the nozzle and cause the valve stem to release the pressurized pepper spray.

13. The method of claim 12, wherein a greater force is required to press the actuator during the second actuation stage than is required to press the actuator during the first actuation stage.

* * * * *